US010081911B2

(12) United States Patent
Matsuyama

(10) Patent No.: US 10,081,911 B2
(45) Date of Patent: Sep. 25, 2018

(54) METHOD FOR MANUFACTURING BRASS-PLATED STEEL WIRE AND APPARATUS FOR DRAWING BRASS-PLATED STEEL WIRE

(75) Inventor: Koji Matsuyama, Tokyo (JP)

(73) Assignee: Kabushiki Kaisha Bridgestone, Chuo-ku, Tokyo (JP)

( * ) Notice: Subject to any disclaimer, the term of this patent is extended or adjusted under 35 U.S.C. 154(b) by 1400 days.

(21) Appl. No.: 12/864,117

(22) PCT Filed: Jan. 26, 2009

(86) PCT No.: PCT/JP2009/051224

§ 371 (c)(1),
(2), (4) Date: Jul. 22, 2010

(87) PCT Pub. No.: WO2009/093734

PCT Pub. Date: Jul. 30, 2009

(65) Prior Publication Data

US 2010/0294013 A1 Nov. 25, 2010

(30) Foreign Application Priority Data

Jan. 25, 2008 (JP) ..... 2008-015261

(51) Int. Cl.

| | |
|---|---|
| ***B21C 1/00*** | (2006.01) |
| ***B21C 1/04*** | (2006.01) |
| ***D07B 1/06*** | (2006.01) |

(52) U.S. Cl.

CPC ..... *D07B 1/0666* (2013.01); *B21C 1/003* (2013.01); *B21C 1/04* (2013.01); *D07B 2205/3089* (2013.01)

(58) Field of Classification Search

CPC .. B21C 1/003; B21C 1/02; B21C 1/04; B21C 3/02

(Continued)

(56) References Cited

U.S. PATENT DOCUMENTS 3,651,682 A * 3/1972 Henrich ..... 72/281
5,189,897 A * 3/1993 Lionetti et al. ..... 72/278

(Continued)

FOREIGN PATENT DOCUMENTS

JP 08024938 A * 1/1996 ..... B21C 1/00
JP 11-309509 A 11/1999

(Continued)

OTHER PUBLICATIONS

International Search Report for PCT/JP2009/051224, dated Apr. 28, 2009, 2 pages.

*Primary Examiner* — Debra Sullivan
(74) *Attorney, Agent, or Firm* — Sughrue Mion, PLLC

(57) ABSTRACT

A wire drawing apparatus (10) is used in a final drawing process to ensure adequate initial performance of adhesion between brass-plated steel wire and rubber without a drop in productivity. At least one of the die (14*z*) disposed in the most downstream position, the die (14*y*) disposed in the second most downstream position, and the die (14*x*) disposed in the third most downstream position is a drawing die having a friction coefficient μ of 0.12 to 0.41 with the brass-plated steel wire. The other dies (14) are drawing dies each having a friction coefficient μ of 0.1 or below. By using these drawing dies, brass-plated steel wire (13) is drawn, and a noncrystalline portion of high lattice defect density is formed on the surface of the crystalline portion of the brass-plating layer of the brass-plated steel wire (13).

3 Claims, 3 Drawing Sheets

(58) Field of Classification Search
USPC ..... 72/274–291, 467
See application file for complete search history.

(56) References Cited

U.S. PATENT DOCUMENTS

| | | | | |
|---|---|---|---|---|
| 5,535,612 | A * | 7/1996 | Vijayakar | 72/43 |
| 5,823,039 | A * | 10/1998 | Umeda et al. | 72/286 |
| 7,617,713 | B2 * | 11/2009 | Zelin | 72/467 |
| 2003/0136171 | A1 * | 7/2003 | Goto | 72/467 |
| 2011/0247388 | A1 * | 10/2011 | Rhee et al. | 72/380 |

FOREIGN PATENT DOCUMENTS

| | | | |
|---|---|---|---|
| JP | 3291638 | B2 | 6/2002 |
| JP | 2006-283270 | A | 10/2006 |

* cited by examiner $$\mu = \alpha \left( \frac{\frac{Pz}{A1 \cdot Y} - \frac{2}{3}\alpha}{\ln \frac{A0}{A1}} - 1 \right)$$

Y; YIELD STRESS OF WIRE

FIG.3

| | FRICTION COEFFICIENT μ | | | | ADHESION INDEX | DIE LIFE INDEX | WIRE BREAKING INDEX |
|---|---|---|---|---|---|---|---|
| | 4TH MOST DOWNSTREAM DIE | 3RD MOST DOWNSTREAM DIE | 2ND MOST DOWNSTREAM DIE | MOST DOWNSTREAM DIE | | | |
| COMPARATIVE EXAMPLE 1 | 0.10 | 0.09 | 0.08 | 0.10 | 100 | 100 | 100 |
| EXAMPLE 1 | 0.09 | 0.09 | 0.10 | 0.20 | 82 | 100 | 100 |
| EXAMPLE 2 | 0.09 | 0.09 | 0.10 | 0.22 | 81 | 100 | 100 |
| EXAMPLE 3 | 0.10 | 0.09 | 0.10 | 0.41 | 77 | 100 | 100 |
| EXAMPLE 4 | 0.09 | 0.10 | 0.21 | 0.09 | 84 | 100 | 100 |
| EXAMPLE 5 | 0.11 | 0.20 | 0.10 | 0.10 | 88 | 100 | 100 |
| EXAMPLE 6 | 0.10 | 0.20 | 0.10 | 0.10 | 87 | 100 | 100 |
| EXAMPLE 7 | 0.09 | 0.08 | 0.20 | 0.18 | 75 | 100 | 100 |
| EXAMPLE 8 | 0.10 | 0.20 | 0.21 | 0.10 | 78 | 100 | 100 |
| EXAMPLE 9 | 0.10 | 0.21 | 0.20 | 0.18 | 45 | 100 | 100 |
| COMPARATIVE EXAMPLE 2 | 0.09 | 0.09 | 0.42 | 0.10 | 50 | 70 | 150 |
| COMPARATIVE EXAMPLE 3 | 0.10 | 0.42 | 0.20 | 0.13 | 50 | 50 | 170 |
| COMPARATIVE EXAMPLE 4 | 0.10 | 0.48 | 0.45 | 0.43 | 50 | 30 | 210 |
| COMPARATIVE EXAMPLE 5 | 0.21 | 0.09 | 0.10 | 0.09 | 100 | 100 | 100 |

*FRICTION COEFFICIENT OF DIES BEFORE 4TH MOST DOWNSTREAM DIE ; $\mu \leqq 0.1$

METHOD FOR MANUFACTURING BRASS-PLATED STEEL WIRE AND APPARATUS FOR DRAWING BRASS-PLATED STEEL WIRE

TECHNICAL FIELD

The present invention relates to a method for manufacturing steel wire having a brass plating layer on the surface thereof, which is used for instance as filaments for a tire reinforcement steel cord, and an apparatus for drawing such brass-plated steel wire.

BACKGROUND ART

Conventionally, rubber articles, such as belts of a radial tire, body plies of a carcass, and belt members for use in various industries, have used brass-plated steel wires or steel cords of a plurality of brass-plated steel wires stranded together, which are coated with rubber. In this way, they have gained a reinforcement effect on the rubber thereof. To achieve such a reinforcement effect, an adequate adhesion must be ensured between the brass-plated steel wire and the rubber coating thereon. For example, in the curing process of tire manufacture, the steel cord in contact with the rubber is heated to form an adhesion layer through a reaction of sulfur in the rubber with copper in the brass plating. Therefore the steel cords for use in rubber articles are required to have high performance (adhesion performance) of quickly and reliably forming an adhesion layer.

In a conventional method proposed for improving the adhesion performance between the brass-plated steel wire and the rubber, a noncrystalline portion consisting of crystal grains of 20 nm or less in grain size is formed on the surface side of the crystalline portion of the brass plating layer consisting of crystal grains of over 20 nm in grain size. And this noncrystalline portion promotes a quick progress of adhesive reaction between the brass-plated steel wire and the rubber (see Reference 1, for instance).

Reference 1: Japanese Unexamined Patent Application Publication No. 2006-283270

DISCLOSURE OF THE INVENTION

Problems to be Solved by the Invention

Among the methods proposed for providing an noncrystalline portion on the surface side of the crystalline portion of the brass plating layer, there are one in which brass-plated steel wire is drawn with a lowered concentration of lubricative contents of the lubricating liquid in a wet drawing process, thereby forming a heavy-worked layer on its surface, and one in which an noncrystalline brass plating layer is formed on the surface of the crystalline brass plating layer by a plasma CVD or like process.

These methods, however, have problems that the breaking of wire can happen frequently when the drawing is done with a lowered concentration of lubricative contents and besides the reduced service life of dies used in drawing the brass-plated steel wire leads to a drop in productivity.

Also, the method for forming a noncrystalline brass plating layer by a plasma CVD or like process may not be a practical method since it tends to require elaborate equipment.

The present invention has been made in view of such conventional problems, and an object thereof is to provide a method for manufacturing brass-plated steel wire for reinforcement of rubber articles, which can ensure adequate initial adhesion performance between the brass-plated steel wire and the rubber without allowing a drop in productivity, and an apparatus for drawing such brass-plated steel wire.

Means for Solving the Problem

According to a first aspect of the present invention, there is provided an apparatus for drawing a brass-plated steel wire, which includes a plurality of dies for sequentially drawing a steel wire having a brass plating layer on its surface. The plurality of dies are a most downstream die disposed in the most downstream position of a final drawing process, a second most downstream die disposed in the second most downstream position before the most downstream die, a third most downstream die disposed in the third most downstream position before the second most downstream die, and anterior dies disposed in the anterior positions before the third most downstream die. In this wire drawing apparatus, the friction coefficient of the anterior dies with the brass-plated steel wire is below 0.12, and the friction coefficient of at least one of the most downstream die, the second most downstream die, and the third most downstream die is 0.12 to 0.41.

According to a second aspect of the present invention, there is provided an apparatus for drawing a brass-plated steel wire according to claim 1, wherein the friction coefficient of a die or dies other than one or ones having a friction coefficient of 0.12 to 0.41, among the most downstream die, the second most downstream die, and the third most downstream die, is below 0.12.

According to a third aspect of the present invention, there is provided an apparatus for drawing a brass-plated steel wire, which includes a plurality of dies for sequentially drawing a steel wire having a brass plating layer on its surface. The plurality of dies are a most downstream die disposed in the most downstream position of a final drawing process, a second most downstream die disposed in the second most downstream position before the most downstream die, and a third most downstream die disposed in the third most downstream position before the second most downstream die. In this wire drawing apparatus, the friction coefficient of at least one of the most downstream die, the second most downstream die, and the third most downstream die is 0.12 to 0.41, and the friction coefficient of a die or dies other than one or ones among the most downstream die, the second most downstream die, and the third most downstream die whose friction coefficient is 0.12 to 0.41 is below 0.12.

According to a fourth aspect of the present invention, there is provided an apparatus for drawing a brass-plated steel wire, in which the friction coefficient of at least one of the most downstream die, the second most downstream die, and the third most downstream die is 0.18 to 0.22.

According to a fifth aspect of the present invention, there is provided an apparatus for drawing a brass-plated steel wire, which includes a plurality of dies for sequentially drawing a steel wire having a brass plating layer on its surface. The plurality of dies are a most downstream die disposed in the most downstream position of a final drawing process, a second most downstream die disposed in the second most downstream position before the most downstream die, a third most downstream die disposed in the third most downstream position before the second most downstream die, and anterior dies disposed in the anterior positions before the third most downstream die. In this wire drawing apparatus, the friction coefficient of the anterior dies on the brass-plated steel wire is 0.1 or below, and the friction coefficient of at least one of the most downstream die, the second most downstream die, and the third most downstream die is 0.12 to 0.41.

According to a sixth aspect of the present invention, there is provided an apparatus for drawing a brass-plated steel wire, in which the friction coefficient of a die or dies other than one or ones among the most downstream die, the second most downstream die, and the third most downstream die whose friction coefficient is 0.12 to 0.41 is 0.1 or below.

According to a seventh aspect of the present invention, there is provided an apparatus for drawing a brass-plated steel wire, which includes a plurality of dies for sequentially drawing a steel wire having a brass plating layer on its surface. The plurality of dies are a most downstream die disposed in the most downstream position of a final drawing process, a second most downstream die disposed in the second most downstream position before the most downstream die, and a third most downstream die disposed in the third most downstream position before the second most downstream die. In this wire drawing apparatus, the friction coefficient of at least one of the most downstream die, the second most downstream die, and the third most downstream die is 0.12 to 0.41, and the friction coefficient of a die or dies other than one or ones among the most downstream die, the second most downstream die, and the third most downstream die whose friction coefficient is 0.12 to 0.41 is 0.1 or below.

According to an eighth aspect of the present invention, there is provided an apparatus for drawing a brass-plated steel wire, in which the friction coefficient of at least one of the most downstream die, the second most downstream die, and the third most downstream die is 0.18 to 0.22.

According to a ninth aspect of the present invention, there is provided a method for manufacturing a brass-plated steel wire by drawing a brass-plated steel wire using a brass-plated steel wire drawing apparatus as described in any of the first to eighth aspects of the present invention.

Note that the above-mentioned friction coefficient μ can be approximated by the following Siebel's equation where, as shown in FIG. 2, A0 is the sectional area of brass-plated steel wire 13 before introduction into the drawing die 14, A1 is the sectional area of brass-plated steel wire 13 after drawing through the drawing die 14, α is the die angle of the drawing die 14, and Pz is the drawing force applied to the brass-plated steel wire 13. In the present invention, the friction coefficient μ between the drawing die 14 and the brass-plated steel wire 13 is adjusted as appropriate by changing A0, A1, α, and Pz in relation to the value of wire yield stress Y of the brass-plated steel wire 13 to be drawn.

$$\mu = \alpha\left(\frac{\frac{Pz}{A1 \cdot Y} - \frac{2}{3}\alpha}{\ln\frac{A0}{A1}} - 1\right) \quad \text{[Equation 1]}$$

*Y*: Yield stress of wire

Effect of the Invention

In the manufacturing method of a brass-plated steel wire according to the present invention, the brass-plated steel wire is drawn in the final drawing process with at least one of the final drawing die and two drawing dies upstream thereof used as a drawing die whose friction coefficient μ is 0.12 to 0.41. As a result, the extreme surface of the brass plating layer only is subjected to a heavy-working and a noncrystalline portion of high lattice defect density, consisting of crystal grains of 20 nm or less in grain size, can be formed on the surface side of the crystalline portion of the brass plating layer without the shortening of die life. Also, since the occurrence of wire breaking can be reduced, it is possible to adequately ensure the initial performance of adhesion between the brass-plated steel wire and the rubber without a drop in productivity.

Further, if the friction coefficient μ of at least one of the final drawing die and two drawing dies upstream thereof with the brass-plated steel wire is 0.18 to 0.22, it is possible not only to reliably form a noncrystalline portion on the surface side of the crystalline portion, but also to further control the occurrence of wire breaking. Preferably, if the friction coefficient μ is 0.18 to 0.21, the above-mentioned effects will be further enhanced.

Also, if the friction coefficient of a die or dies other than one or ones whose friction coefficient μ is 0.12 to 0.41 is below 0.12, or more specifically 0.1 or below, then the brass-plated steel wire may undergo no unnecessary working. This will ensure an adequate initial adhesion performance between the brass-plated steel wire and the rubber without a loss in the performance of the brass-plated steel wire. Furthermore, this will prevent the shortening of service life of the die or dies other than one or ones whose friction coefficient μ is 0.12 to 0.41.

BRIEF DESCRIPTION OF THE DRAWINGS

FIG. 3 is a table showing the results of investigation on the friction coefficients of the dies used in Examples and the adhesiveness, die life, and wire breaking of the brass-plated steel wires prepared in them.

REFERENCE NUMERALS

10 wire drawing apparatus
11 lubricant tank
11*m* liquid lubricant
12A, 12B drive capstan
14 anterior die
14*x* third most downstream die
14*y* second most downstream die
14*z* most downstream die (final die)
15 drive capstan

BEST MODE FOR CARRYING OUT THE INVENTION

Best Mode (Preferred Embodiments)

Preferred embodiments of the present invention will be described hereinbelow with reference to the accompanying drawings.

Figure 1:
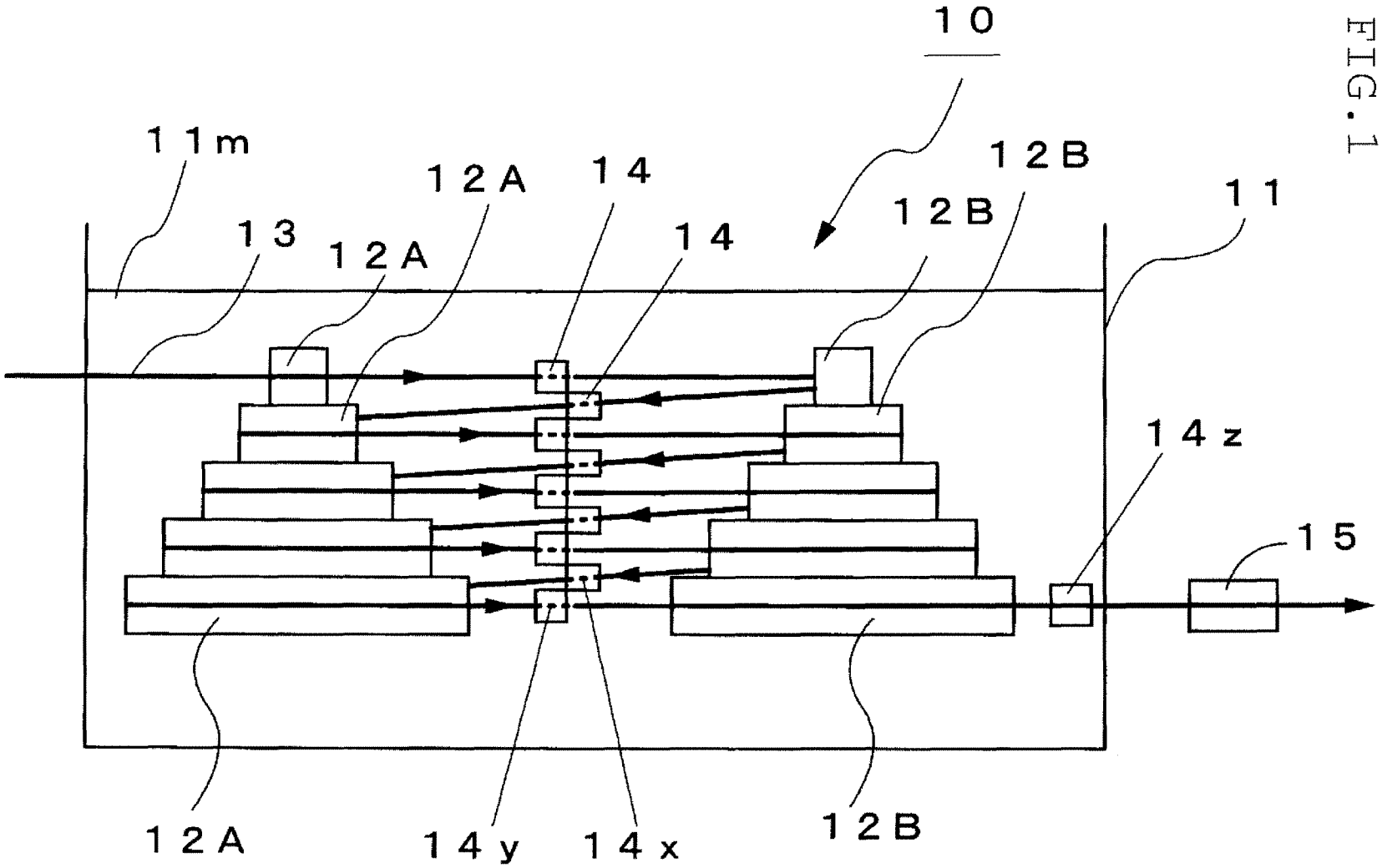
FIG. 1 is a schematic illustration showing a wire drawing apparatus according to a preferred embodiment of the present invention.
Figure 2:
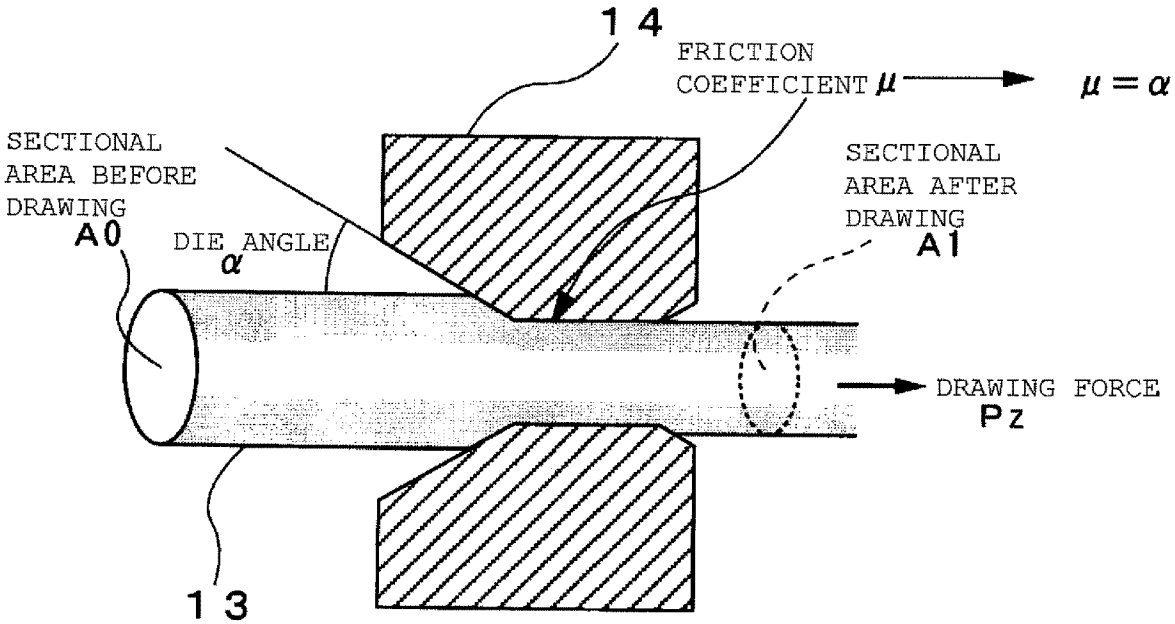
FIG. 2 is an illustration for explaining a relationship between the friction coefficient μ of a die and the drawing conditions for the brass-plated steel wire.

FIG. 1 is a schematic illustration showing a multistage slip type wet wire drawing apparatus 10 according to a preferred embodiment of the present invention. This multistage slip type wet wire drawing apparatus 10 is used in a final drawing process in which a steel wire having a brass plating layer on its surface is drawn after the process of patenting heat treatment or the like. The wire drawing apparatus 10 includes a lubricant tank 11 filled with a liquid lubricant 11*m*, multidtage drive capstans 12A and 12B disposed in the liquid lubricant 11*m*, a plurality of drawing dies 14, 14*x*, 14*y*, and 14*z*, and a drive capstan 15. Note here that the drawing die 14*z* is a final die (hereinafter referred to as the most downstream die). The drawing die 14*y* is a die before the most downstream die 14*z* (the second most downstream die). The drawing die 14*x* is a die before the second most downstream die 14*y* (the third most downstream die). The drawing dies 14 are dies disposed before the third most downstream die 14*x* (hereinafter referred to as anterior dies).

A description will now be given of a final drawing process by a wire drawing apparatus 10. Firstly, a brass-plated steel wire 13 is alternately passed between and engaged with each stage of two multistage drive capstans 12A and 12B which are disposed opposite to each other in a liquid lubricant 11*m* in a lubricant tank 11. In doing so, the wire is drawn by drawing dies 14 (14, 14*x*, 14*y*) in their respective stages. Then, the brass-plated steel wire 13, having been processed to a predetermined diameter after passage through a most downstream die 14*z*, is sent to a not-shown winding process by a drive capstan 15. Through the process as described above, the brass-plated steel wire 13 is drawn into a predetermined wire diameter (0.1 to 0.4 mm in diameter) by the use of more than twenty dies.

In the present embodiment, a drawing die whose friction coefficient μ with the brass-plated steel wire is 0.2 (hereafter μ representing the friction coefficient of a die) is used as the most downstream die 14*z* of the above-mentioned dies, and drawing dies whose friction coefficient μ is 0.1 or below are used as the second most downstream die 14*y*, the third most downstream die 14*x*, and the anterior dies 14.

It should be noted that the anterior dies 14 are made of cemented carbide such as tungsten carbide (WC) whereas the downstream dies 14*x* to 14*z* are diamond dies. The friction coefficients μ of the dies 14, 14*x* to 14*z* are each adjusted by changing the sectional area A0 of brass-plated steel wire before drawing through the die, the sectional area A1 of brass-plated steel wire after drawing through the die, the die angle α, and the drawing force Pz to be applied to the brass-plated steel wire 13 in Siebel's equation in relation to the value of the yield stress Y of the brass-plated steel wire 13 to be drawn.

Since the most downstream die 14*z* has a larger friction coefficient μ than those of the preceding dies 14*y*, 14*x*, and 14, the extreme surface of the drawn brass-plated steel wire 13 is subjected to a heavy-working. As a result, a noncrystalline portion consisting of crystal grains of 20 nm or less in grain size is formed on the surface side of the crystalline portion of the brass plating layer. Therefore, the brass-plated steel wire 13 manufactured in this way has a noncrystalline portion of high lattice defect density on the surface of the brass plating layer, so that heating the brass-plated steel wire 13 in contact with rubber will cause a quick progress of adhesive reaction between the brass-plated steel wire and the rubber. Thus, the initial adhesion performance improves as an adhesion layer is formed quickly between the brass-plated steel wire 13 and the rubber.

When the friction coefficient μ of the most downstream die 14*z* is below 0.12, the surface of the brass plating layer remains crystalline without being fully heavy-worked and therefore the progress of adhesive reaction between the brass plating layer and the rubber will be slow. Consequently, it is difficult to improve the initial adhesion performance. On the other hand, when the friction coefficient μ of the most downstream die 14*z* exceeds 0.41, the friction between the die and the brass-plated steel wire becomes too large while although the initial adhesion performance may improve. This may accelerate the wear of the die, which will not only shorten the die life but also cause frequent breaking of wire. Therefore, it is necessary that the friction coefficient μ of the most downstream die 14*z* be in the range of 0.12 to 0.41.

Note that in the present embodiment drawing dies whose friction coefficient μ is 0.1 or below are used as the second most downstream die 14*y*, the third most downstream die 14*x*, and the anterior dies 14. As a result, no unnecessary processing other than the heavy-working by the most downstream die 14*z* is done on the brass-plated steel wire 13, so that there results no loss in the performance of the brass-plated steel wire 13. Also, since the friction coefficient μ of the dies 14, 14*x*, and 14*y* is 0.1 or below, the service life of those dies will be long.

Thus, according to the preferred embodiments of the present invention, the wire drawing apparatus used in the final drawing process is such that a drawing die whose friction coefficient μ with the brass-plated steel wire is 0.2 is used as the most downstream die 14*z* while drawing dies whose friction coefficient μ is 0.1 or below are used as the second most downstream die 14*y*, the third most downstream die 14*x*, and the anterior dies 14. And a brass-plated steel wire 13 is drawn using these dies, so that a noncrystalline portion of high lattice defect density is formed on the surface side of the crystalline portion of the brass plating layer of the brass-plated steel wire 13. This will not only improve the adhesion performance of the brass-plated steel wire 13 while retaining the die life but also can sufficiently reduce the frequency of wire breaking.

It should be appreciated, however, that although the friction coefficient μ of the most downstream die 14*z* is 0.2 in the preferred embodiments, the friction coefficient μ is acceptable if its value is in the range of 0.12 to 0.41. Also, in those embodiments, the most downstream die 14*z* only among the dies used in the final drawing process is the drawing die whose friction coefficient μ is 0.2, but this condition should not be binding. The arrangement may be such that at least one of three dies, namely, the most downstream die 14*z*, the second most downstream die 14*y*, and the third most downstream die 14*x*, is used as a drawing die whose friction coefficient μ is 0.12 to 0.41. In other words, there may even be two or three drawing dies whose friction coefficient μ is 0.12 to 0.41. Even in such a case, it should be noted that the friction coefficient μ of the die or dies other than the one or ones whose friction coefficient μ is 0.12 to 0.41 is preferably below 0.12, and more preferably 0.1 or below.

Also, as the at least one drawing die out of the three dies 14*x*, 14*y*, and 14*z*, it is preferable to use a drawing die whose friction coefficient μ is 0.12 to 0.41, more preferable to use one whose friction coefficient μ is 0.18 to 0.22, and most preferable to use one whose friction coefficient μ is in the range of 0.18 to 0.21.

EXAMPLES

In the final drawing process, a brass-plated steel wire was drawn with at least one of three dies, namely, the most downstream die, the second most downstream die, and the third most downstream die, used as a drawing die whose friction coefficient μ was 0.12 to 0.41. The results of investigations on the adhesiveness, die life, and breaking of wire are shown in the table of FIG. 3.

The brass-plated steel wire of Example 1 was drawn with the most downstream die only used as a drawing die whose friction coefficient μ was 0.20 and the other dies used as drawing dies whose friction coefficient μ was 0.1 or below.

The brass-plated steel wire of Example 2 was drawn with the most downstream die only used as a drawing die whose friction coefficient μ was 0.22 and the other dies used as drawing dies whose friction coefficient μ was 0.1 or below.

The brass-plated steel wire of Example 3 was drawn with the most downstream die only used as a drawing die whose friction coefficient μ was 0.41 and the other dies used as drawing dies whose friction coefficient μ was 0.1 or below.

The brass-plated steel wire of Example 4 was drawn with the second most downstream die only used as a drawing die whose friction coefficient μ was 0.21 and the other dies used as drawing dies whose friction coefficient μ was 0.1 or below.

The brass-plated steel wire of Example 5 was drawn with the third most downstream die only used as a drawing die whose friction coefficient μ was 0.20 and the fourth most downstream die used as one whose friction coefficient μ was 0.11. Note that the friction coefficient μ of the other dies was 0.1 or below.

The brass-plated steel wire of Example 6 was drawn with the third most downstream die only used as a drawing die whose friction coefficient μ was 0.20 and the other dies used as drawing dies whose friction coefficient μ was 0.1 or below.

The brass-plated steel wire of Example 7 was drawn with the most downstream die used as a drawing die whose friction coefficient μ was 0.18 and the second most downstream die used as drawing die whose friction coefficient μ was 0.20. Note that the friction coefficient μ of the other dies was 0.1 or below.

The brass-plated steel wire of Example 8 was drawn with the second most downstream die used as a drawing die whose friction coefficient μ was 0.21 and the third most downstream die used as drawing die whose friction coefficient μ was 0.20. Note that the friction coefficient μ of the other dies was 0.1 or below.

The brass-plated steel wire of Example 9 was drawn with the most downstream die used as a drawing die whose friction coefficient μ was 0.18, the second most downstream die used as drawing die whose friction coefficient μ was 0.20, and the third most downstream die used as drawing die whose friction coefficient μ was 0.21. Note that the friction coefficient μ of the other dies was 0.1 or below.

Also, for comparison, the brass-plated steel wire (Comparative Example 1) was prepared by drawing it with the dies whose friction coefficient μ was all 0.1 or below. Also, the brass-plated steel wires (Comparative Examples 2 to 4) were prepared by drawing them with the dies of which at least one of three dies, namely, the most downstream die, the second most downstream die, and the third most downstream die, was a drawing die whose friction coefficient μ exceeded 0.41. Also, the brass-plated steel wire (Comparative Example 5) was prepared by drawing it with the fourth most downstream die, disposed before the third most downstream die, whose friction coefficient μ was 0.21, and the most downstream die, the second most downstream die, and the third most downstream die whose friction coefficient μ was all below 0.12. And the results of investigations on the adhesiveness, die life, and breaking of wire thereof are also shown in the table of FIG. 3.

The adhesion performance was evaluated by the time taken for the brass-plated steel wire to be completely (100%) coated with rubber when it was heated in contact with the rubber. It was represented by an index number relative to that of Comparative Example 1 being 100. The smaller the number is, the better the adhesiveness will be.

The die life was evaluated by the weight of the brass-plated steel wire that can be produced using the die and was represented by an index relative to that of Comparative Example 1 being 100. The larger the number is, the longer the die life and the higher the productivity will be.

The breaking of wire was evaluated by the count of breaking when the brass-plated steel wire was drawn under a tension of 10 tons. It was represented by an index number relative to that of Comparative Example 1 being 100. The smaller the number is, the less frequent the breaking of wire will be.

As is clear from the table of FIG. 3, the brass-plated steel wires of Examples 1 to 9 prepared by a manufacturing method of the present invention show improvements of adhesion performance by 12% to 55% while retaining the die life and frequency of wire breaking equivalent to those of the brass-plated steel wire of Comparative Example 1 drawn with the dies whose friction coefficient μ was all 0.1 or below. From this, it has been confirmed that the use of the manufacturing method of the present invention can not only improve the performance of adhesion with the rubber without a drop in productivity but also can reduce the frequency of wire breaking sufficiently.

Also, it has been found that the adhesion performance further improves with an increase in the number of drawing dies whose friction coefficient μ is 0.12 to 0.41.

Also, as indicated by Examples 4 to 6 and Example 8, it has been confirmed that even when the friction coefficient μ of the most downstream drawing die is 0.1 or below, the adhesion performance improves with the use of the second most downstream and third most downstream drawing dies whose friction coefficient μ is 0.18 to 0.22.

In contrast to this, when drawing is done with the dies of which at least one of three dies, namely, the most downstream die, the second most downstream die, and the third most downstream die, was a drawing die whose friction coefficient μ exceeds 0.41, the initial adhesion performance improves in all cases, but the die life becomes shorter, the productivity drops, and the breaking of wire happens frequently. Thus, it has been confirmed that the friction coefficient of dies for heavy-working must be 0.41 or below.

Also, even when the friction coefficient μ of the fourth most downstream die disposed before the third most downstream die is 0.21, characteristics equivalent only to those of Comparative Example 1 can be obtained if the friction coefficient μ of three dies, namely, the most downstream die, the second most downstream die, and the third most downstream die, is below 0.12. Thus, it has been confirmed that a die whose friction coefficient μ is 0.12 to 0.41 must be used as at least one of three dies, namely, the most downstream die, the second most downstream die, and the third most downstream die.

INDUSTRIAL APPLICABILITY

The brass-plated steel wire manufactured according to the present invention features excellent adhesiveness with rubber. Therefore, it can be suitably used not only as steel cords of steel radial tires but also as a reinforcement member for high-pressure hoses, industrial belts, and other rubber articles.

The invention claimed is:

1. An apparatus for drawing a brass-plated steel wire, the apparatus comprising a plurality of dies for sequentially drawing a steel wire having a brass plating layer on the surface thereof, the plurality of dies comprising:

a most downstream die disposed in the most downstream position of a final drawing process;

a second most downstream die disposed in the second most downstream position before the most downstream die;

a third most downstream die disposed in the third most downstream position before the second most downstream die; and anterior dies disposed in anterior positions before the third most downstream die;

wherein the friction coefficient of the anterior dies with the brass-plated steel wire is below 0.12, wherein the friction coefficient of the most downstream die is 0.21 to 0.41, wherein the most downstream die has a larger friction coefficient than the second most downstream die and the third most downstream die, wherein the friction coefficient of second most downstream die is less than 0.1, and wherein the friction coefficient of third most downstream die is less than 0.1.

2. The apparatus for drawing a brass-plated steel wire according to claim 1, wherein the friction coefficient of the most downstream die is 0.21 to 0.22.

3. A method for manufacturing a brass-plated steel wire, comprising: drawing the brass-plated steel wire using the brass-plated steel wire drawing apparatus as recited in claim 1.

* * * * *